US005820016A

United States Patent [19]

Stropkay

[11] Patent Number: 5,820,016

[45] Date of Patent: Oct. 13, 1998

[54] CUP AND LID

[75] Inventor: Scott Stropkay, Carlisle, Mass.

[73] Assignee: Dunkin' Donuts Incorporated, Randolph, Mass.

[21] Appl. No.: 647,622

[22] Filed: May 13, 1996

[51] Int. Cl.[6] ..... B65D 3/22; B65D 17/34

[52] U.S. Cl. ..... 229/403; 206/459.5; 220/469; 220/713; 220/787; 229/906.1

[58] Field of Search ..... 229/4.5, 400, 403, 229/404, 906.1; 220/469, 710.5, 711, 713, 716, 718, 739, 787; 206/459.5

[56] References Cited

U.S. PATENT DOCUMENTS

| | | | |
|---|---|---|---|
| Re. 25,618 | 7/1964 | Goodman . | |
| D. 158,187 | 4/1950 | Geerlings . | |
| D. 214,458 | 6/1969 | Riley | D44/9 |
| D. 250,314 | 11/1978 | Elliott et al. | D7/6 |
| D. 259,757 | 7/1981 | Perrin | D7/15 |
| D. 267,850 | 2/1983 | Groenwold et al. | D7/6 |
| D. 282,616 | 2/1986 | Gallagher et al. | D7/40 |
| D. 289,955 | 5/1987 | Buist | D7/3 |
| D. 291,659 | 9/1987 | Powell | D9/341 |
| D. 302,943 | 8/1989 | Cuzenza | D9/337 |
| D. 312,157 | 11/1990 | Sjolander | 32/53 |
| D. 323,116 | 1/1992 | Dart et al. | D9/447 |
| D. 349,950 | 8/1994 | Cummings | D23/283 |
| D. 353,973 | 1/1995 | Adedo | D7/511 |
| 1,098,178 | 5/1914 | Semple . | |
| 1,679,621 | 8/1928 | Myers . | |
| 1,732,322 | 10/1929 | Wilson et al. . | |
| 1,771,765 | 7/1930 | Benson . | |
| 1,962,199 | 6/1934 | Koch et al. . | |
| 2,012,113 | 8/1935 | Thompson . | |
| 2,266,828 | 12/1941 | Sykes . | |
| 2,300,473 | 11/1942 | Van Winkle . | |
| 2,437,784 | 3/1948 | Laskin . | |
| 2,501,815 | 3/1950 | Hamm . | |
| 2,563,352 | 8/1951 | Morse . | |
| 2,591,578 | 4/1952 | McNealy et al. . | |
| 2,617,549 | 11/1952 | Egger . | |
| 2,641,402 | 6/1953 | Brunn . | |
| 2,661,889 | 12/1953 | Phinney . | |
| 2,695,744 | 11/1954 | Gattuso . | |
| 2,828,903 | 4/1958 | Adkines . | |
| 2,861,716 | 11/1958 | Kramer . | |
| 2,969,901 | 1/1961 | Behrens . | |
| 3,079,027 | 2/1963 | Edwards . | |
| 3,085,730 | 4/1963 | Fibish | 229/400 |
| 3,185,341 | 5/1965 | Barbour . | |
| 3,194,468 | 7/1965 | Baron . | |
| 3,203,611 | 8/1965 | Anderson et al. . | |
| 3,220,595 | 11/1965 | Edwards . | |
| 3,237,834 | 3/1966 | Davis et al. . | |
| 3,262,626 | 7/1966 | Davis . | |
| 3,301,459 | 1/1967 | Gardner . | |
| 3,412,892 | 11/1968 | Waksman et al. . | |
| 3,443,714 | 5/1969 | Edwards . | |
| 3,443,715 | 5/1969 | Edwards . | |
| 3,456,860 | 7/1969 | Janninck . | |
| 3,503,310 | 3/1970 | Goetz . | |

(List continued on next page.)

OTHER PUBLICATIONS

*Phil Patton, I.D. Magazine, "Top This", May/June 1996.*

*Primary Examiner*—Gary E. Elkins
*Attorney, Agent, or Firm*—Weingarten, Schurgin, Gagnebin & Hayes LLP

[57] ABSTRACT

A tapered cup having an outwardly rolled lip includes insulating bodies integral with the outer face of the wall of the cup. Thermally conductive channels are among the insulating bodies and have an insulating value that is less then the insulating value of the insulating bodies. The cup can include a groove below the outwardly rolled lip in the inner face of the cup wall. The insulating bodies can be configured as alpha numeric indicia and the outer wall of the bodies or cup can be provided with bumps to aid in stacking of two or more cups. The cup can include a tapered lid with an outwardly flared lip that seats against the inner wall of the cup and does not extend over the lip of the cup. The lid can include a locking ring below the outwardly flared lip of the lid that is adapted for insertion into the groove in the cup. The lid further includes a fluid port.

34 Claims, 20 Drawing Sheets

U.S. PATENT DOCUMENTS

| | | | |
|---|---|---|---|
| 3,519,165 | 7/1970 | Hawley . | |
| 3,527,380 | 9/1970 | Brown . | |
| 3,627,166 | 12/1971 | Walter | 220/54 |
| 3,666,088 | 5/1972 | Wingardh . | |
| 3,679,119 | 7/1972 | Copping | 229/400 |
| 3,722,784 | 3/1973 | Harper | 229/906.1 |
| 3,779,157 | 12/1973 | Ross, Jr. et al. | 100/240 |
| 3,781,183 | 12/1973 | Doll | 229/400 |
| 3,785,254 | 1/1974 | Mann . | |
| 3,797,369 | 3/1974 | Amberg . | |
| 3,890,762 | 6/1975 | Ernst et al. . | |
| 3,908,523 | 9/1975 | Shikaya | 93/36.01 |
| 3,915,355 | 10/1975 | Young | 222/478 |
| 3,938,695 | 2/1976 | Ruff . | |
| 3,951,266 | 4/1976 | Brewer | 206/520 |
| 4,080,880 | 3/1978 | Shikaya . | |
| 4,099,642 | 7/1978 | Negard . | |
| 4,133,446 | 1/1979 | Albert . | |
| 4,136,799 | 1/1979 | Albert | 220/415 |
| 4,146,660 | 3/1979 | Hall et al. | 428/2 |
| 4,176,054 | 11/1979 | Kelley | 209/8 |
| 4,190,173 | 2/1980 | Mason et al. | 220/203 |
| 4,261,501 | 4/1981 | Watkins et al. . | |
| 4,359,160 | 11/1982 | Myers et al. | 206/519 |
| 4,394,928 | 7/1983 | Philip | 220/366 |
| 4,398,650 | 8/1983 | Holmes et al. | 220/443 |
| 4,410,578 | 10/1983 | Miller | 428/117 |
| 4,548,349 | 10/1985 | Tunberg . | |
| 4,615,459 | 10/1986 | Clements . | |
| 4,756,420 | 7/1988 | Deaton | 206/514 |
| 4,836,400 | 6/1989 | Chaffey et al. . | |
| 4,986,437 | 1/1991 | Farmer . | |
| 4,993,580 | 2/1991 | Smith | 220/443 |
| 5,009,326 | 4/1991 | Reaves et al. | 220/441 |
| 5,076,463 | 12/1991 | McGraw | 220/415 |
| 5,085,336 | 2/1992 | Lynd | 220/708 |
| 5,092,485 | 3/1992 | Lee | 220/441 |
| 5,109,996 | 5/1992 | Sullivan | 215/11.6 |
| 5,111,957 | 5/1992 | Hollander et al. | 220/408 |
| 5,145,107 | 9/1992 | Silver et al. . | |
| 5,183,172 | 2/1993 | Boller | 220/711 |
| 5,191,979 | 3/1993 | Nemeroff | 229/400 |
| 5,197,624 | 3/1993 | Dodaro | 229/906.1 |
| 5,205,473 | 4/1993 | Coffin, Sr. . | |
| 5,226,585 | 7/1993 | Varano . | |
| 5,363,982 | 11/1994 | Sadlier | 220/441 |
| 5,385,260 | 1/1995 | Gatcomb | 220/415 |
| 5,425,497 | 6/1995 | Sorensen | 220/738 |
| 5,490,631 | 2/1996 | Iioka et al. | 229/403 |
| 5,547,124 | 8/1996 | Mueller | 229/403 |

CUP AND LID

FIELD OF THE INVENTION

The invention relates to covered drinking vessels, and more particularly to disposable cups and lids.

BACKGROUND OF THE INVENTION

Paper cups, plastic cups, insulated cups, and the like, with and without covers, are not new. However, cups configured to meet the particular demands of a high-volume, rapid-response service establishment, fast-food restaurant, or coffee shop are unknown. These establishments have very specific requirements related to cups and lids with respect to lid storage and inventory control; beverage preparation and distribution; consumer safety and satisfaction; and cost containment. The following examples illustrate some of the deficiencies of presently known cups and lids.

A typical establishment stores thousands of cups. The cups are typically packaged and stored in nested stacks which are easily compressed even when properly stored and handled. Thus, one or more cups in each stack bind to adjacent cups and become difficult to separate. Sometimes a stack of cups becomes so severely compressed that cups are damaged. A stack of bound cups is usually provided to a beverage server for use. When the stack is depleted it is augmented by another stack of cups. The beverage server not uncommonly has to use two hands to remove a cup from the stack. Frequently, more than one cup is removed from the stack and must be replaced. This is not only inconvenient, but it can also severely slow down service, thereby frustrating queued patrons. Known cups do not provide features that protect cups from stacking related damage nor facilitate easy and sure removal of a single cup from a stack. Similarly, known lids can be difficult to store and access. For example, like cups, stacked lids can compress, rendering it difficult to extract a single lid from a stack.

Having a single cup in hand, the beverage server must accurately fill the cup with a predetermined volume of liquid, cover the cup with a lid, and render the covered cup to a patron. The speed and accuracy with which this operation is performed has a significant impact on profitability and customer satisfaction. Known lids are commonly difficult to properly position, snap, and seal on a cup.

Significant problems related to cups are also attendant to the service of hot beverages such as coffee. For example, most disposable coffee cups are very difficult to handle for several minutes after being filled. However, not infrequently it takes a person just grasping a hot cup several moments to realize that it will be uncomfortable to hold the cup until it cools, and the cup is placed on a table. This situation is problematic with regard to highly popular "drive-thru" service since vehicle occupants are often under way again before discomfort is perceived and the options for and convenience of setting the cup aside are constrained. Additional difficulties arise when a vehicle operator attempts to tear off or tear back and secure a tab on the lid of the cup, while driving, to be able to drink the coffee. Furthermore, once an opening has been made in the lid, coffee from a filled cup can slosh out of the opening. In this context it would be desirable to provide a disposable coffee cup that is comfortable to hold while the coffee is hot, yet provide some indication of the temperature of the liquid within the cup, and still be easy to drink from without making a mess. Known disposable cups do not meet these needs.

Additionally, as known thin-walled paper and plastic cups are too hot to handle for a while after being filled, customers and beverage servers commonly nest two or more cups together to provide insulation. This is undesirable as it decreases profit margin and increases trash volume; but it also makes a filled cup increasingly unstable or tipsy as each additional cup is added for insulation. On the other hand, well-insulated styrofoam cups are also known. These cups, however, can provide such effective insulation that it is difficult to determine whether the liquid within the cup is hot or cold simply by touching the cup. Additionally, these cups lack the rigidity necessary to be safely held once the capacity of the cup exceeds a few ounces, unless the styrofoam is particularly robust, which leads to a very awkwardly sized and shaped container.

In addition to having less-than-desirable thermal and mechanical properties, known disposable cups are typically mated with a lid that snaps over the top rim of the cup. In addition the difficulties recited above with respect to the pull-back and lock type tabs, these lids are undesirable for other reasons. For example, known lids cover the lip of the cup and often include a radially projecting annular flange of thin, sharp plastic that does not provide a pleasant lip feel. Additionally, known lids are not easily seated on the lip of the cup and readily pop-off when the walls of the cup are flexed. Furthermore, as one attempts to suck hot liquid through the hole in the lid, the nose is firmly pressed against the lid and into puddles of coffee retained in pockets on the lid. Although this discomfort could be eliminated by removing the lid from the cup, so that it is possible to drink naturally, it is well recognized that one almost never removes the lid from a cup of hot coffee in a moving vehicle. Finally, until the first inch or so of hot coffee is slurped out of the cup, there is a constant risk of getting splashed with coffee even from a cup with a lid after the pull-tab is removed from the lid.

In sum, none of the known lid and cup combinations provide the pleasant sensation of drinking from a comfortably warm, smooth-lipped ceramic mug with the convenience and disposability of paper and plastic lid cup combinations; nor do the known cup and lid combinations address the service and safety requirements of the fast-food world. Thus, there is still room for improvement of the venerable cup.

SUMMARY OF THE INVENTION

The present invention overcomes the deficiencies of known disposable cup and lid combinations by providing a cup and lid combination which has superior insulating properties; is comfortable, safe, and clean to hold when filled with hot liquid; is easy to drink from; is structurally sound; is not readily collapsed; is easy to store; and is easy to manipulate.

In a first embodiment, a cup includes a resilient, hollow, frustoconical body open at a first end and closed at a second end. The first end has a greater diameter than the second end, and the body includes a wall having an inner face and an outer face. The wall extends from the first end to the second end of the body and has an outwardly rolled lip at the open first end. Insulating bodies are integral with the outer face of the cup wall. Thermally conductive channels are among the plurality of insulating bodies and have an insulating value that is less than the insulating value of the insulating bodies. The cup can include a groove below the outwardly rolled lip in the inner face of the cup wall. The cup can also include stacking bumps that increase the diameter of the cup at one or more localized regions.

In another embodiment, the cup is combined with a lid. The lid includes a resilient, hollow, frustroconical body open at a first end and closed at a second end, wherein the first end has a greater diameter than the second end. The body includes a wall having an inner face and an outer face. A wall extends from the first end to the second end, and it has an outwardly flared lip at the open first end. A locking ring can be provided below the outwardly flared lip, wherein the locking ring is adapted for insertion into the groove of the cup. The closed second end of the lid defines a fluid port. The lip of the lid has a diameter that is less than the diameter of the open first end of the cup.

DESCRIPTION OF THE DRAWINGS

The invention will be more fully understood from the following detailed description taken in conjunction with the accompanying drawings in which.

DETAILED DESCRIPTION OF THE INVENTION

Figure 1:
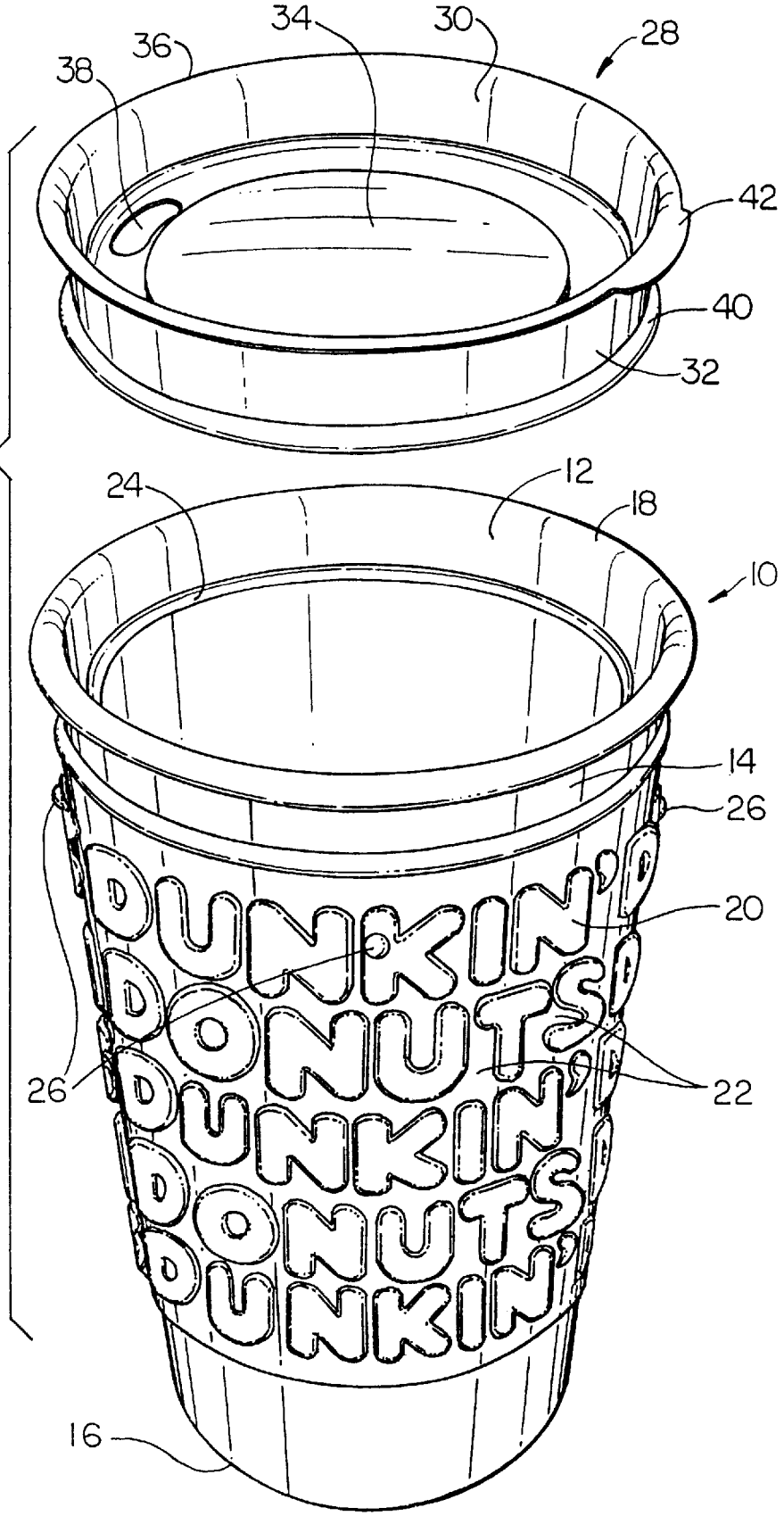
FIG. 1 is a perspective view of a cup and lid in accordance with the invention.

FIG. 1 illustrates a cup and lid combination or assembly in accordance with the invention. The cup and lid combination is shown in an exploded view or separated to illustrate features of each. The cup 10 is a hollow, tapered, frustroconical body having a wall with an inner face 12 and an outer face 14, a closed bottom or base 16, and an open mouth defined by an outwardly rolled lip 18 at the free end of the cup wall. The mouth of the cup has a larger diameter than the base of the cup.

All or a portion of the outer face 14 of the cup is provided with insulating bodies 20 that locally increase the thickness of the cup wall. The insulating bodies 20 can be solid or air filled as desired to affect the insulating value "R" of the insulating bodies. The insulating bodies 20 can be integral with, internal to, or applied to the wall of the cup. In the illustrated embodiment, the insulating bodies 20 are configured as alphanumeric indicia integral with the cup wall. In other embodiments the insulating bodies 20 are integral with a sleeve that surrounds at least a portion of the outer face 14 of the cup. In still other embodiments, the insulating bodies 20 are defined by a space between a sleeve that surrounds at least a portion of the outer face 14 of the cup and the outer face of the cup; and the insulating bodies are configured to resist crushing under normal gripping forces to maintain the insulating space. In embodiments with a sleeve, the sleeve is permanently joined to the outer face of the cup 14 using techniques known to those skilled in the art, and the insulating bodies thus defined are considered integral with the outer face of the cup.

The insulating bodies 20 are partially or completely separated from each other by thermally conductive channels 22 having a lower insulating value than the insulating bodies. In the illustrated embodiment, the thermally conductive channels 22 include regions of the wall that are thinner than the wall regions having insulating bodies 20 therein or thereon. In embodiments with a sleeve surrounding at least a portion of the outer face 14 of the cup, the thermally conductive channels 22 correspond to regions where there is no space between the sleeve and the outer face of the cup, or where there is less space between the sleeve and the face of the cup than in the spaced apart regions that define the insulating bodies 20. Regions with no space between the sleeve and the outer face of the cup provide additional points for attaching the sleeve to the outer face of the cup .

When the illustrated cup 10 is grasped by hand, the hand makes contact substantially only with the raised indicia 20. However, heat is conducted through the thermally conductive channels 22 to provide a sensation of warmth or heat in relation to the temperature of the liquid within the cup 10. The irregular shape of the raised indicia provide an especially secure grasping surface. Furthermore, it should be noted that the indicia are excellent advertising media.

The size, shape and density of the insulating bodies 20, in addition to the thermal properties of the materials used to form the insulating bodies and the cup wall, alter the insulating properties and the crush resistance of the cup 10, as do the size, number, and spacing of the thermally conductive channels 22. The particular dimensions of the insulating bodies 20 and thermally conductive channels 22 can be modified in accordance with the intended temperature of a liquid which will be poured into the cup 10.

When the insulating bodies 20 are completely within the wall of the cup, a smooth outer cup face is provided. Alternatively, the thermally conductive channels 22 among the insulating bodies 20 can comprise or be filled with a material having a lower insulating value than the insulating bodies. In each of these embodiments, one can comfortably hold the cup 10 filled with a hot liquid, yet remain aware of the temperature of the cup contents.

The cup 10 further includes a circumferential recess, indent, or groove 24 subjacent the lip 18 of the cup and stacking bumps 26 which provide a localized increase in the diameter of the cup. Although the groove 24 is shown as a single, uninterrupted recess, the groove can include several similar recesses vertically along the inner face 12 of the cup and/or several interrupted recesses in the same plane. In the illustration, stacking bumps 26 are provided on one or more insulating bodies 20. However, stacking bumps 26 can be located as desired on the outer face 14 of the cup 10.

Associated with the cup 10 is a lid 28. The lid 28 is a hollow, tapered, frustroconical body having a wall with an inner face 30 and an outer face 32, a closed bottom or base 34, and an open mouth defined by an outwardly flared lip 36 at the free end of the lid wall. The lid defines a fluid port 38 that is a simple opening through the base 34 in this embodiment. The lid can further include a locking ring 40 on the outer face 32 of the lid wall or integral with the wall of the lid and which is adapted to be recessed within the groove 24 in the inner face 12 of the cup wall. Although the locking ring 40 is shown as a single, uninterrupted structure, the locking ring can include several similar structures vertically along the outer wall 32 of the lid and/or several interrupted structures in the same plane. The wall of the lid and the lip 36 are contoured to match the taper of the cup wall and curvature of the lip of the cup 18. A tab 42 can be provided on the lid 28.

In the illustrated embodiments the cup 10 is fabricated from paper or co-extruded foam and the lid 28 is plastic. Both the cup 10 and the lid 28 are slightly resilient so that when the lid is pushed into the cup and the locking ring 40 on the lid is aligned with the groove 24 in the cup, the locking ring seats within the groove. The outer face 32 of the lid is pressed against the adjacent inner face 12 of the cup and the lip 36 of the lid presses against the lip 18 of the cup. The locking ring 40 and groove 24, the taper of the cup, and the nested lips 36 and 18, prevent the lid 28 from being inserted into the cup 10 other than a preselected distance, unless force which would damage or severely deform the lid and/or cup is applied to the lid. Thus, the lid 28 is able to be quickly and properly positioned within the cup 10 to provide a fluid-tight seal, wherein the only outlet for a liquid within the cup is through the fluid port 38 in the lid.

Figure 2:
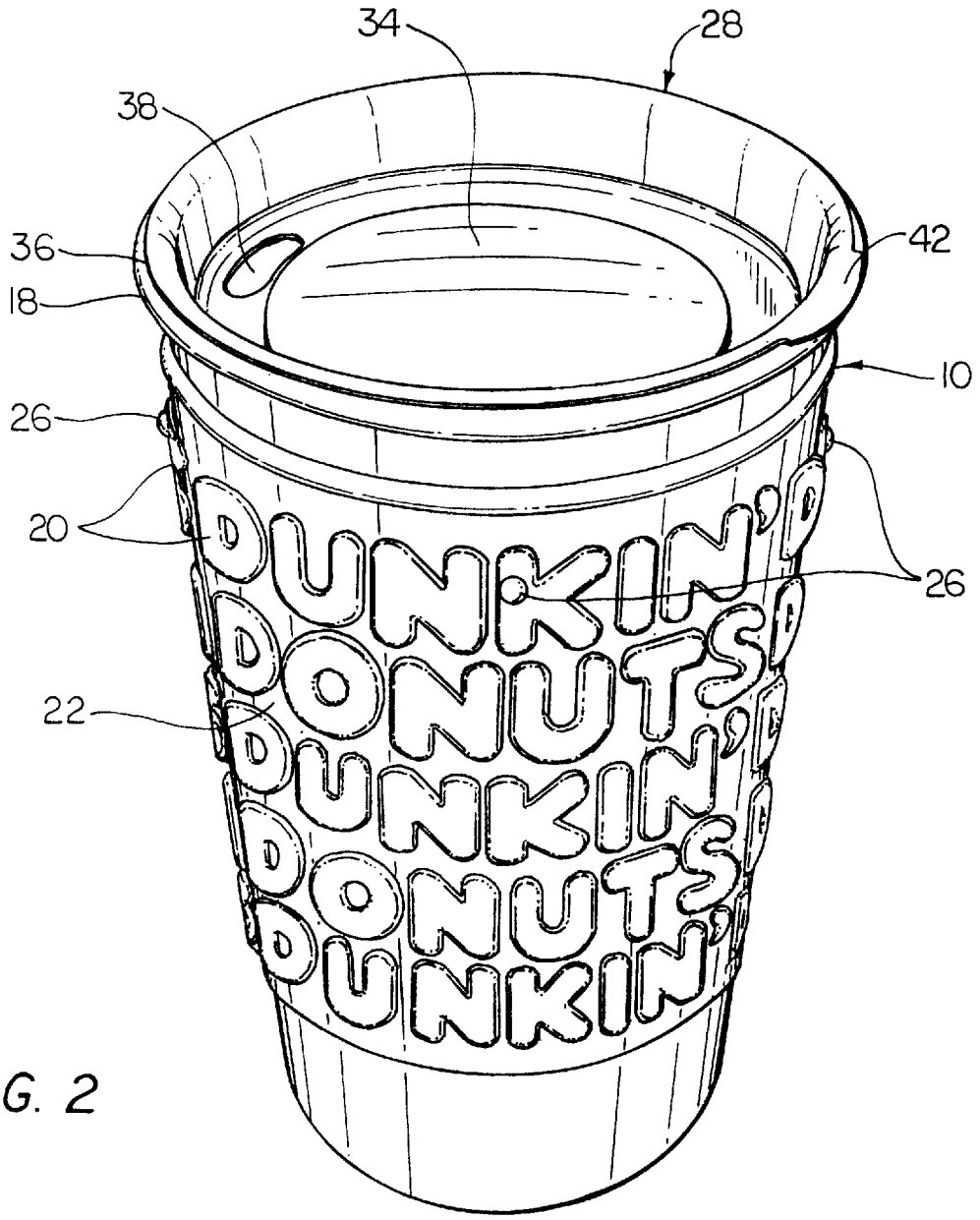
FIG. 2 is a perspective view of the cup and lid shown in a mated condition.

Referring now to FIG. 2, the lid 28 and the cup 10 are shown in a mated relationship. In this view it will be noted that the lip 18 of the cup which is normally exposed to the lips of a person drinking from the cup 10 is not covered by any portion of the lid 28 except along the inner face of the cup. The edge of the lip 36 of the lid is recessed or within the confines of the mouth of the cup and is sufficiently thin so as to be virtually unnoticeable to one drinking from the cup 10. Also, it should be noted that the base 34 of the lid is depressed well below the mouth of the cup to allow a person to drink naturally from the cup 10. The combination of the recessed base 34 and the unencumbered cup lip 18 provides for a drinking experience that is similar to drinking from a cup without any lid, while preserving the safety and cleanliness advantages of a lid. Additionally, the recessed lid 28 reinforces the cup and increases its rigidity to provide a satisfying, solid drinking area or surface.

Another advantage of positioning the base 34 of the lid below the plane defined by the mouth of the cup is that the possibility of dangerously overfilling the cup 10 is eliminated. Initially, the locking groove 24 on the inside of the cup provides a visual indication of the fill level to an individual pouring coffee into the cup. Were this level to be exceeded, coffee would exit the fluid port 38 when the lid 28 is inserted into the cup 10, and then be poured off by the beverage server. If the cup 10 is handed to another individual and some of the liquid sloshes out of the fluid port 38, there is ample reserve within the depressed lid below the mouth of the cup to prevent the coffee from spilling from the cup. In an exemplary embodiment, the base 38 of the lid is ¼ to 1 inch below the mouth of the cup.

In addition to the above safety features, the lid 28 can be provided with a contoured base 34, as shown in this illustration and described hereinbelow with respect to other figures, that urges coffee that has exited the fluid port 38 back into the portion of the cup below the base. It should also be noted that with the exception of the tab 42, there is virtually no surface which extends from the lid 28 beyond the lip 18 of the cup and which could be inadvertently grasped or snagged thereby loosening the lid. Even if the lid 28 were to become dislodged, the lid is readily reseated within the cup 10, and the person seating the lid receives both a tactile and an audible "click" or indication of cup/lid engagement. Furthermore, because the lid seats within the cup, and not over the top of the lip of the cup, it is quite apparent visually when the lid is not properly seated.

Figure 3:
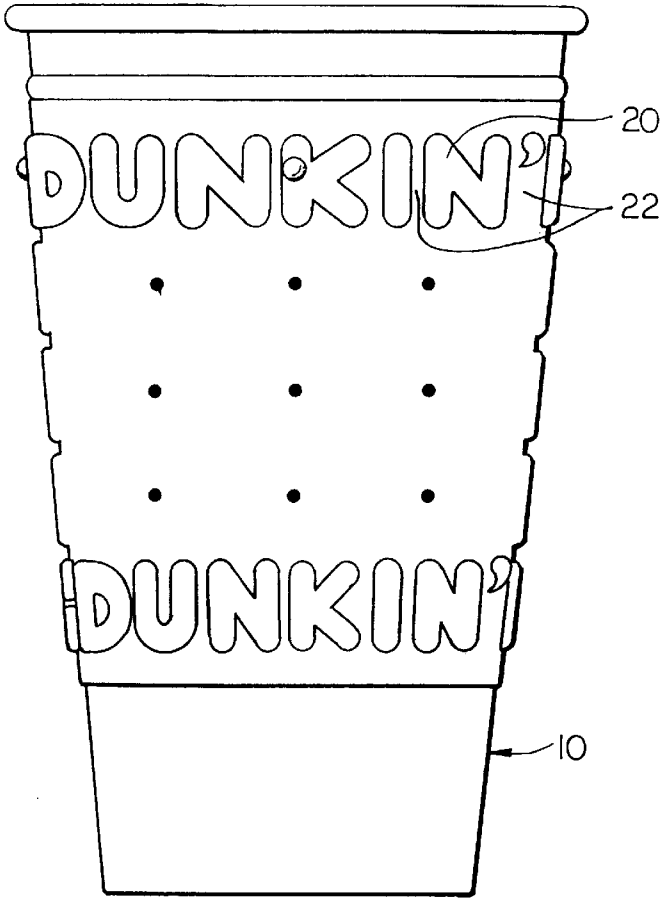
FIG. 3 is a side view of the cup in FIG. 1.

FIGS. 3–6 are side views of various exemplary embodiments of the cup 10 that illustrate different configurations for the insulating bodies 20 and the thermally conductive channels 22. Referring to FIG. 3, for example, thermal control and feedback is provided by raised alphanumeric FIGS. 20 as shown in FIGS. 1 and 2 above. The series of dots on the side of the cup, in this and subsequent figures, represents a continuation of a pattern and is not a feature of the cup.

Figure 4:
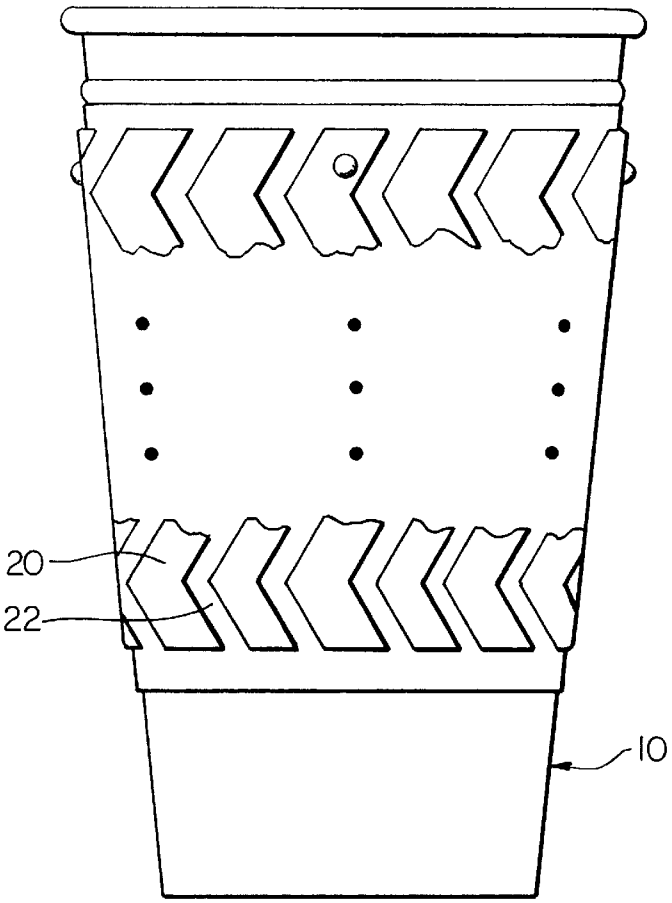
FIG. 4 is a side view of an alternative embodiment of the cup.

FIG. 4 illustrates raised insulating bodies 20 separated by thermally conductive channels 22 in a zig-zag or chevron-shaped pattern similar to tire tread, which provides a good grasping surface.

Figure 5:
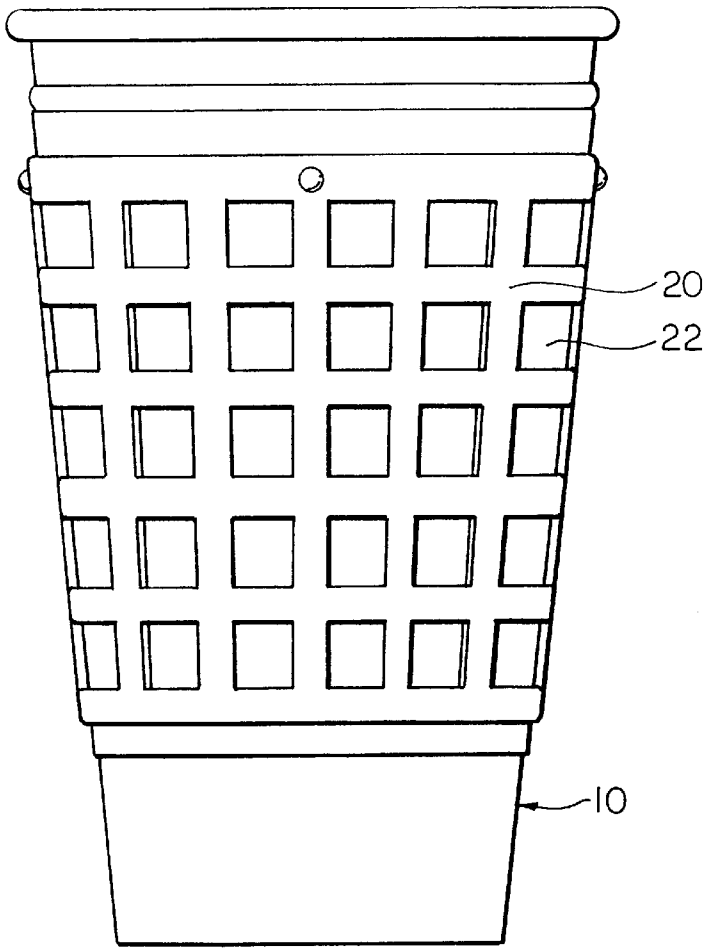
FIG. 5 is a side view of yet another embodiment of the cup.

FIG. 5 illustrates a grid-like configuration, wherein the "lines" of the grid comprise the insulating bodies 20 and the "squares" are the thermally conductive channels 22. Alternatively, the squares defined by the grid can comprise the insulating bodies and the lines can be the thermally conductive channels.

Figure 6:
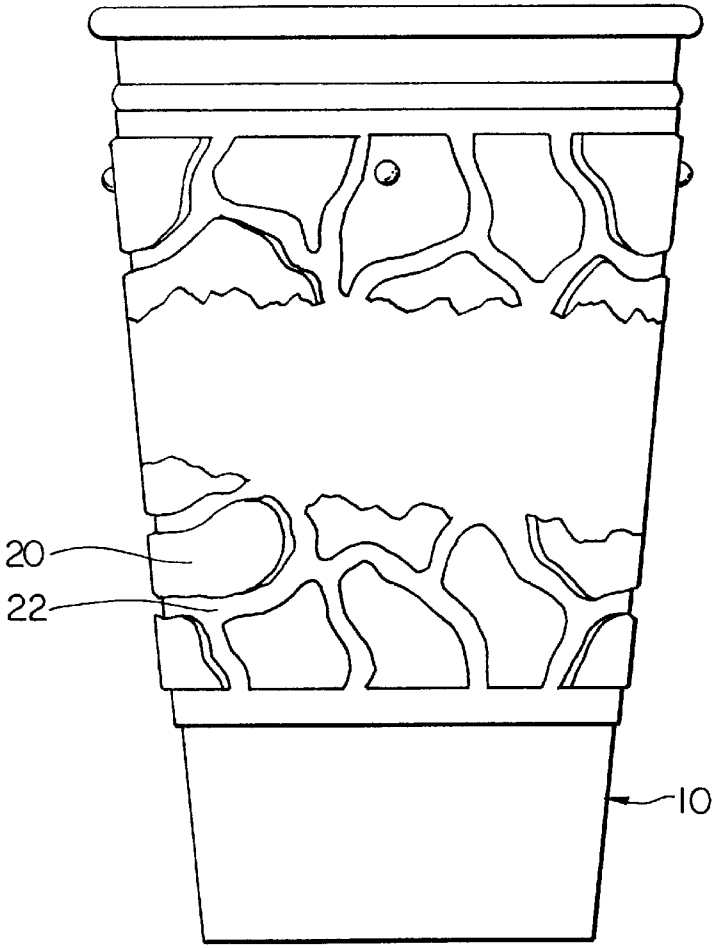
FIG. 6 is an embodiment of still another embodiment of the cup.

FIG. 6 illustrates yet another embodiment of the cup 10 wherein the insulating bodies 20 have an irregular form as do the thermally conductive channels 22.

Figure 7:
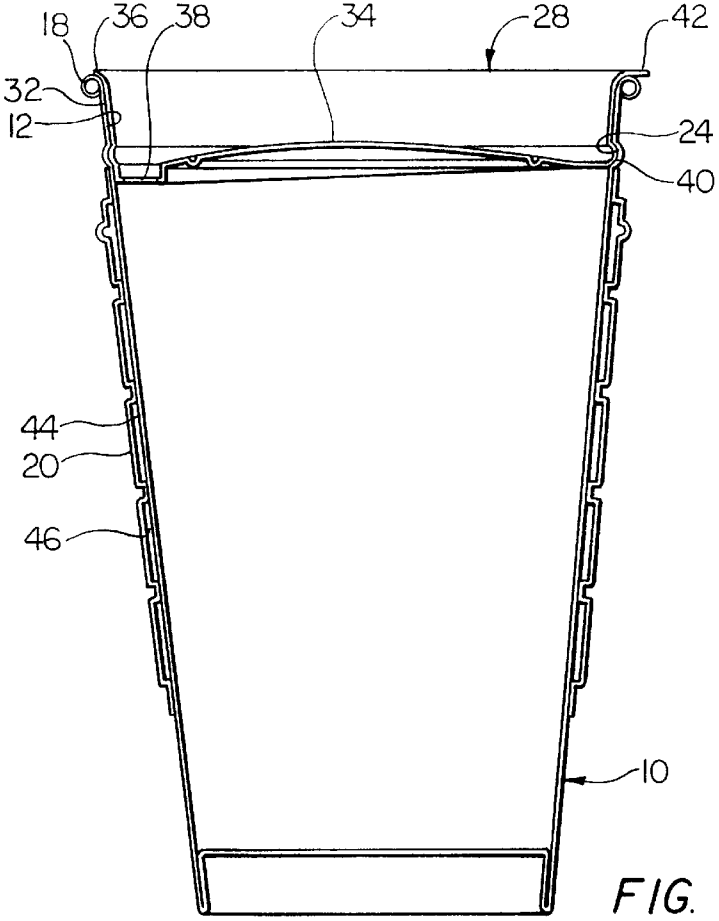
FIG. 7 is a sectional view of the cup and lid illustrated in FIG. 2.

Turning now to FIG. 7, a sectional view of the cup 10 and lid 28 of FIG. 2 is shown. In this view, the tight sealing arrangement between the locking ring 40 and groove 24, the inner face 12 of the cup and outer face 32 of the lid, and the lip 18 of the cup and lip 36 of the lid are clearly shown. In this configuration, the insulating bodies 20 are defined by a sleeve and an outer portion of the cup wall 44 to provide a "double-wall" structure that is particularly robust and insulating, yet not very thick.

In an exemplary embodiment the total thickness of the cup from the inner face of the cup wall to the outermost face of the sleeve or insulating bodies is 0.100 inches and an air-filled gap 46 between the outer face of the cup wall and the inner face of the sleeve or insulating bodies is about 0.056 inches. The insulating bodies are 0.552 inches tall and are separated by thermally conductive channels about 0.090 inches wide. The cup is about 5 and ½ inches tall and holds 14 ounces of fluid. The cup tapers outward from the base of the cup to the lip of the cup at about a 6 degree angle.

Continuing to refer to FIG. 7, the lip 18 of the cup is shown to be unencumbered and uncovered along its upper and outer face by the lip 36, with the exception of the tab 42, which extends slightly over the lip of the cup. Also in this view, the base 34 of the lid is shown to have a substantially convex bow at its center so the liquid is urged toward the outer edge of the base and toward the fluid port 38. In addition to providing good "lip feel," the outwardly rolled cup lip 18 imparts substantial radial integrity and stability to the cup.

Figure 8:
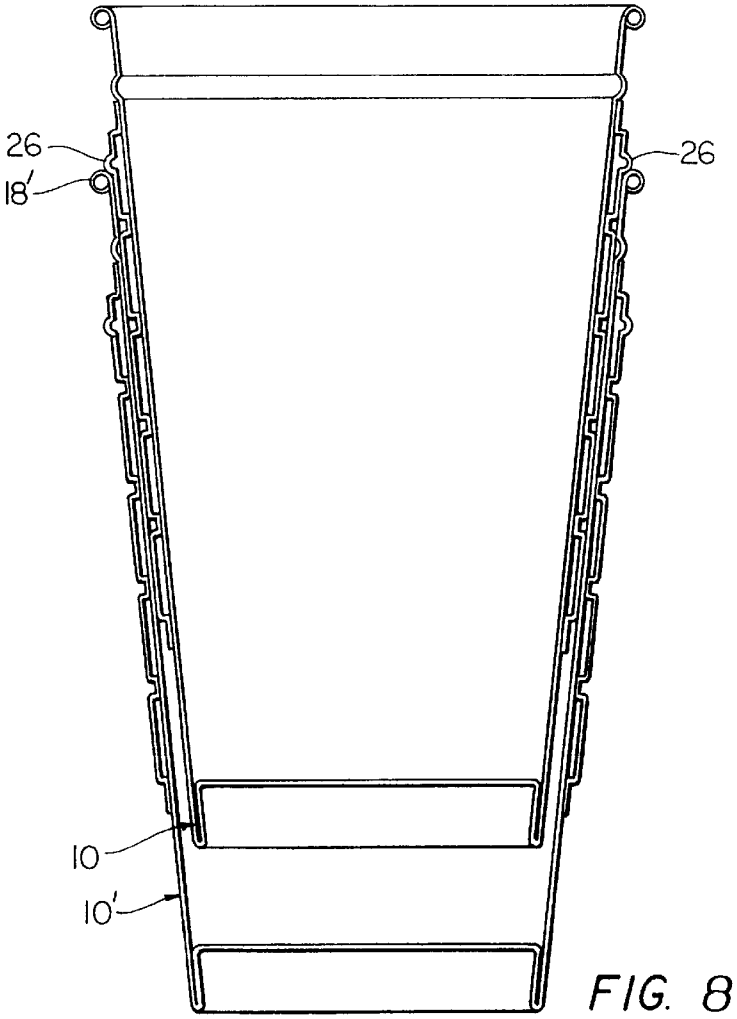
FIG. 8 is a sectional view of two cups in accordance with the invention, wherein a first cup is illustrated nested within a second cup.

FIG. 8 illustrates two cups 10 and 10' in cross-section wherein a first cup 10 is stacked or nested within a second cup 10'. In this view it will be noted that the stacking bumps 26 on the first 10 cup engage the lip 18' of the second cup thereby preventing the first cup from being depressed within the second cup other than by a predetermined distance. Thus, the cups 10 and 10' are not wedged together which would render it difficult to extract one cup from the other. This is particularly important in a fast-service environment wherein a worker must be able to quickly and surely grasp a single cup without pulling either an entire stack or a partial stack along with the cup which would not only be inconvenient but also waste time.

Figure 9:
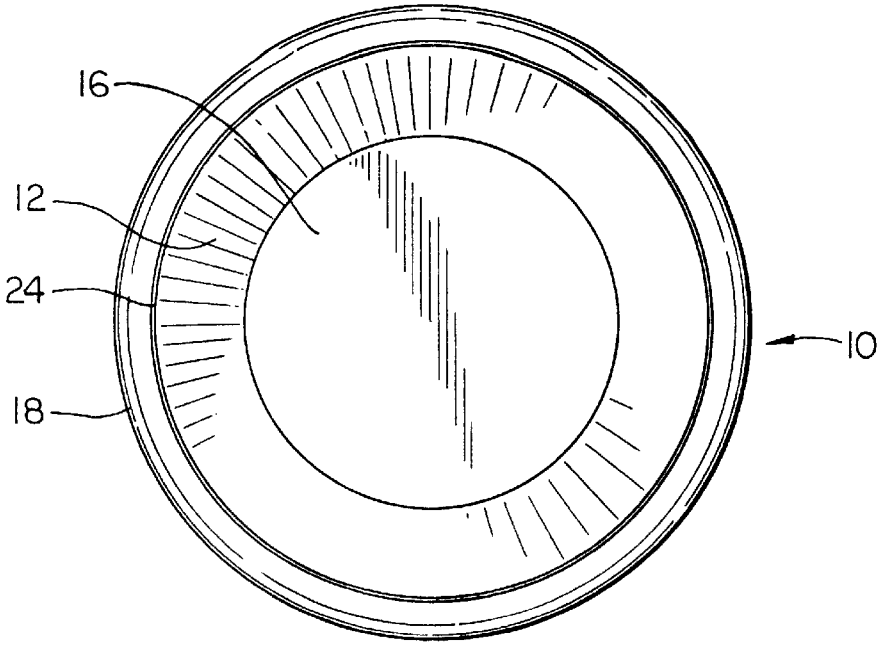
FIG. 9 is a top view of the inside of the cup of FIG. 1.

FIG. 9 is a view of the interior of the cup 10 illustrated in FIGS. 1–8 which shows the bottom of the cup 16, the tapered inner face 12, the locking groove 24, and the lip 18.

Figure 10:
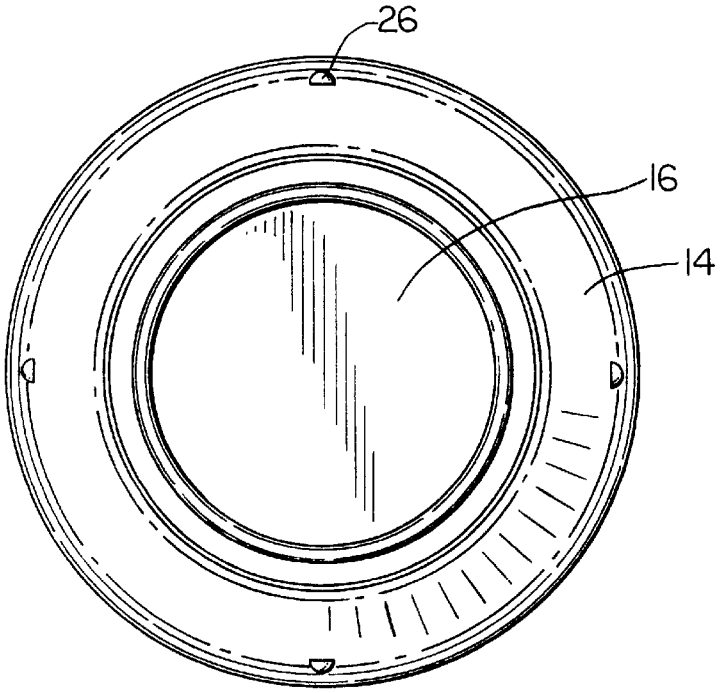
FIG. 10 is a bottom view of the cup of FIG. 1.

FIG. 10 is a bottom view of the cup illustrated in FIGS. 1–9, wherein the bottom of the cup 16, the outer face 14, and the stacking bumps 26 are visible.

Although the cup 10 alone provides many advantages with respect to comfort and safety and is compatible with lids known in the art and which are not represented here, it is believed that even greater advantages are provided by the lid in accordance with the invention, and a number of exemplary lid embodiments are illustrated and described as follows.

Figure 11:
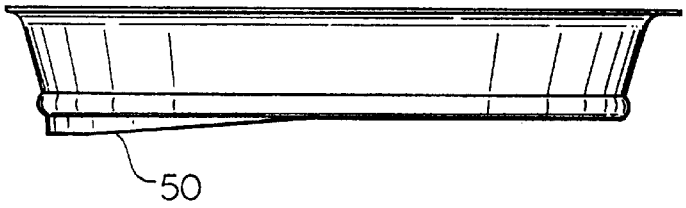
FIG. 11 is a side view of a lid in accordance with the invention.
Figure 12:
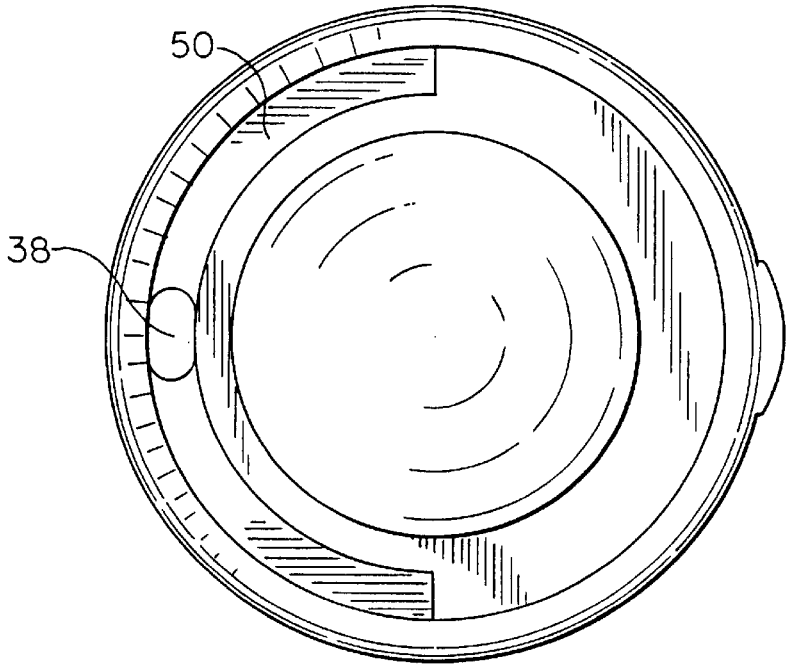
FIG. 12 is a top view of the lid of FIG. 11.
Figure 13:
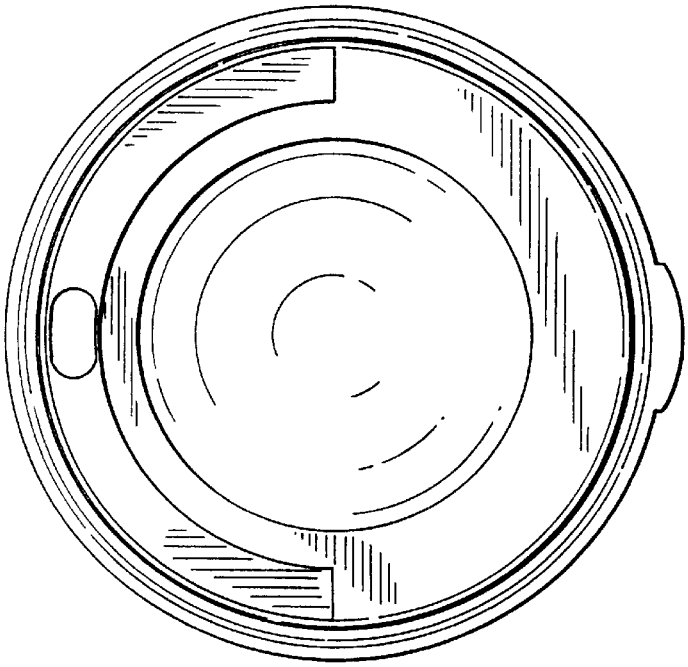
FIG. 13 is a bottom view of the lid of FIG. 11.
Figure 14:
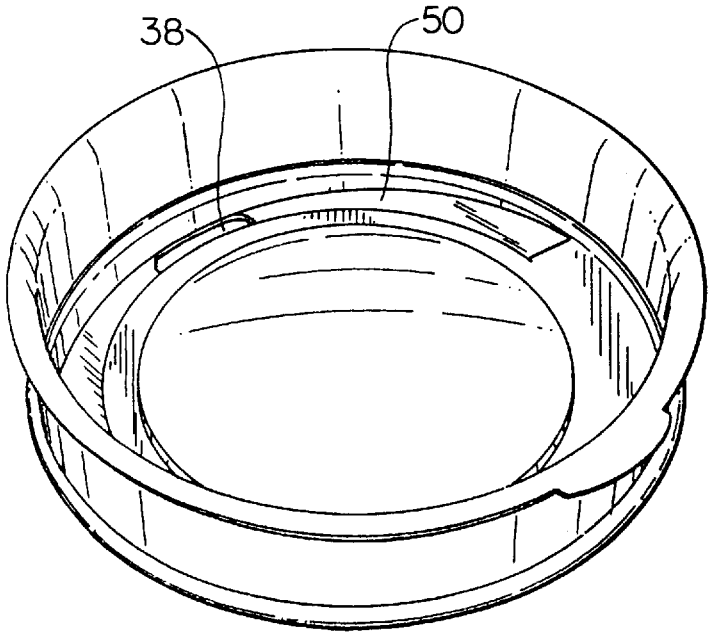
FIG. 14 is a perspective view of the lid of FIG. 11.

FIG. 11 is a side view of an alternative embodiment of a lid in accordance with the invention. FIG. 12 is a top view of the lid of FIG. 11, and FIG. 13 is a bottom view of the lid of FIG. 11. With respect to FIG. 11 it should be noted that a portion of the base of the lid is depressed at one point along the region of the base/wall intersection to define a fluid channel 50 as shown in FIG. 12. As described above, this and the other lids of the invention are configured to not only create a "nose well" but to also urge coffee back into the cup. FIG. 14 is a perspective view of the lid of FIGS. 11–13.

Figure 15:
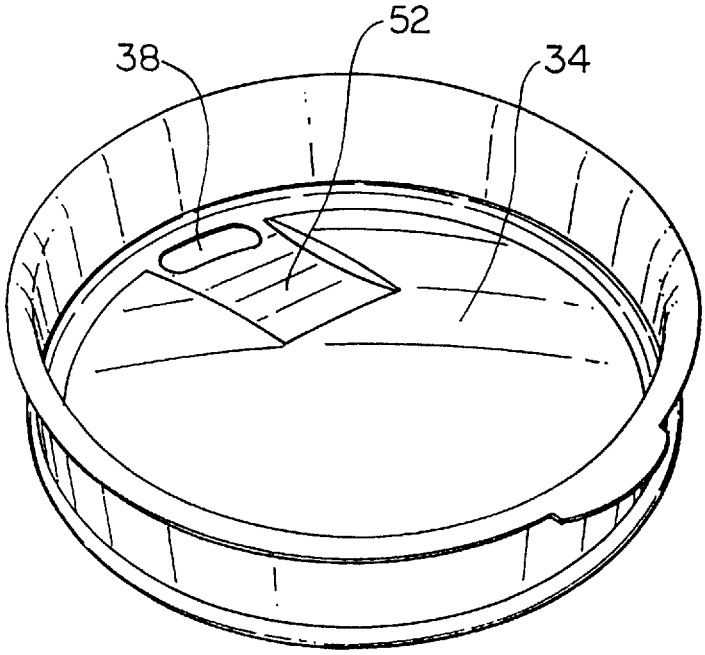
FIG. 15 is a perspective view of an alternative embodiment of the lid of the invention.
Figure 19:
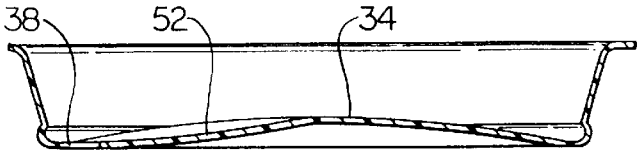
FIG. 19 is a sectional view of the lid of FIG. 15.
Figure 18:
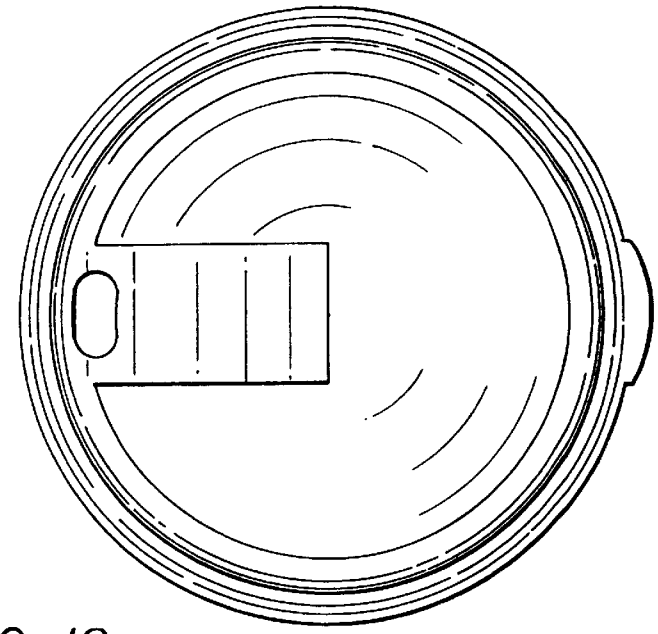
FIG. 18 is a bottom view of the lid of FIG. 15.
Figure 16:
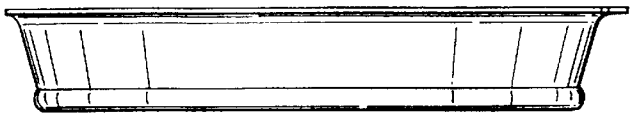
FIG. 16 is a side view of the lid of FIG. 15.
Figure 17:
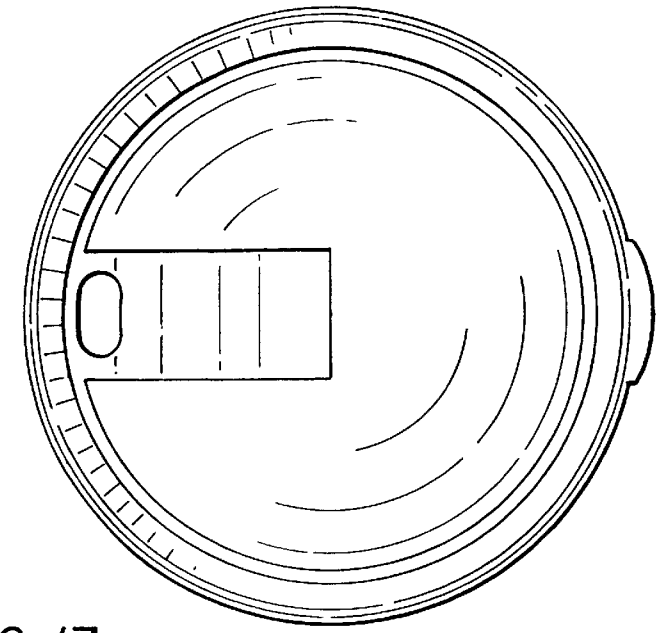
FIG. 17 is a top view of the lid of FIG. 15.

FIG. 15 is a perspective view of another embodiment of a lid, wherein a convex base portion 38 includes a sloped channel or ramp 52 which leads toward the fluid port 38. FIG. 16 is a side view of the lid shown in FIG. 15. FIG. 17 is a top view of the lid in FIG. 15, and FIG. 18 is a bottom view of the lid in FIG. 15. FIG. 19 is a sectional view of the lid shown in FIG. 15, wherein the convex surface of the base 34 is clearly shown as is the ramp 52 leading to the fluid port 38.

Figure 20:
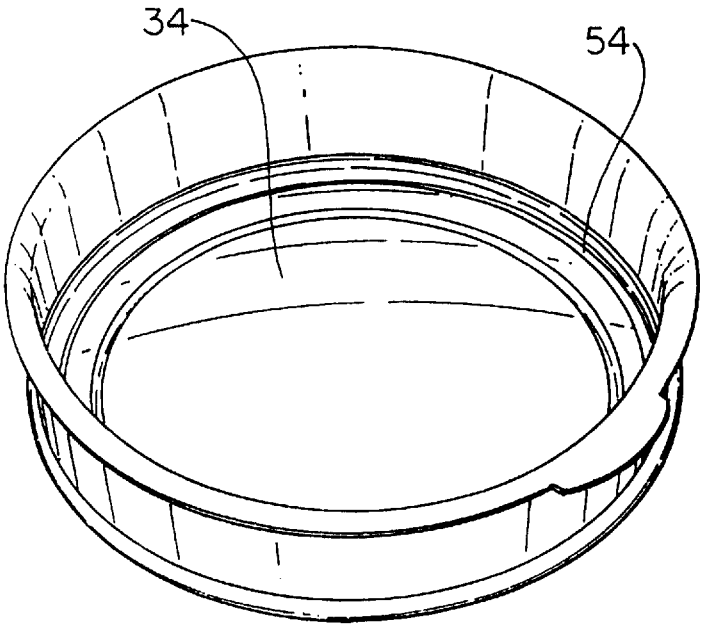
FIG. 20 is a perspective view of yet another embodiment of the lid.
Figure 24:
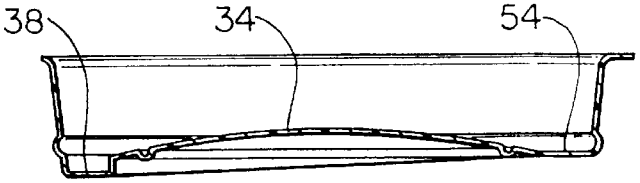
FIG. 24 is a sectional view of the lid of FIG. 20.
Figure 23:
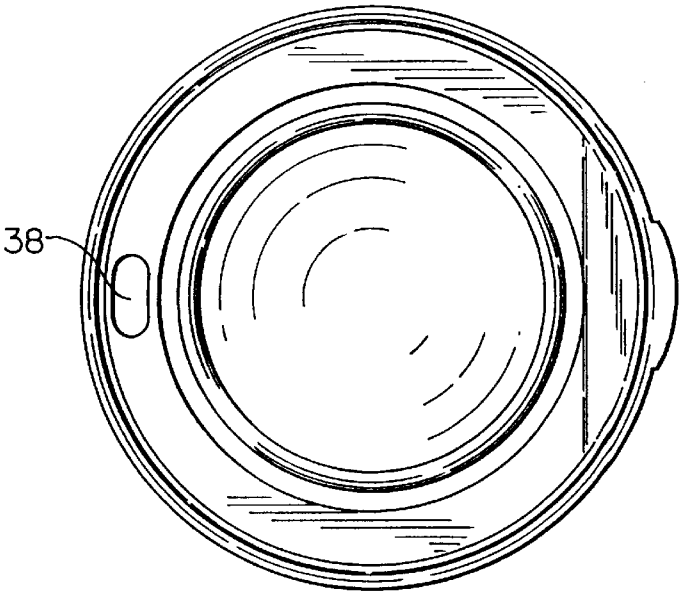
FIG. 23 is a bottom view of the lid of FIG. 20.
Figure 21:
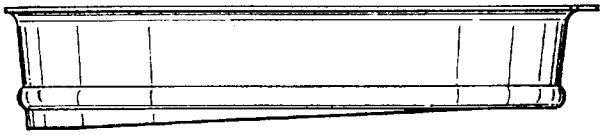
FIG. 21 is a side view of the lid of FIG. 20.
Figure 22:
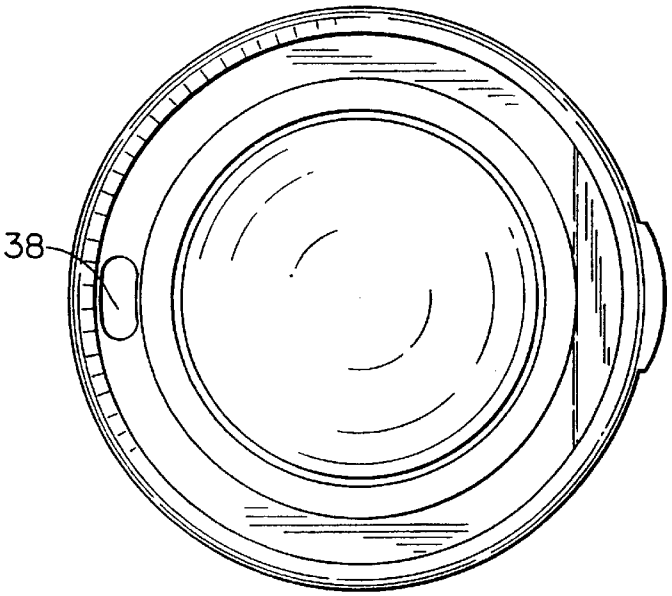
FIG. 22 is a top view of the lid of FIG. 20.

FIG. 20 is a perspective view of yet another embodiment of a lid in accordance with the invention. In this embodiment a convex lid base 34 urges liquid deposited thereon into a circumferential channel 54 which directs fluid into a fluid port which is not visible in this view as it is obscured by the convex surface of the lid base. FIG. 21 is a side view of the lid of FIG. 20, and FIGS. 22 and 23 are respective top and bottom views. In both FIGS. 22 and 23 the fluid port 38 is visible. FIG. 24 is a sectional view of the lid of FIG. 20 showing the convex portion of the lid base 34 and the circumferential channel 54 leading to the fluid port 38 which is slightly below the plane of the channel at a point opposite the fluid port.

In each of the above described embodiments of the lid, the fluid port 38 is always unobstructed so that a customer does not have to tear off, remove, fold or lock anything to access the beverage. Although not needed to prevent spill-over or splash, the lid can be provided with a device that seals the fluid port until the device is adjusted, moved, or manipulated by the user to allow or inhibit fluid flow to and from the fluid port. An important consideration for such a fluid port device is ease of use. FIGS. 25–38 illustrate embodiments of the lid including exemplary fluid port devices.

Figure 25:
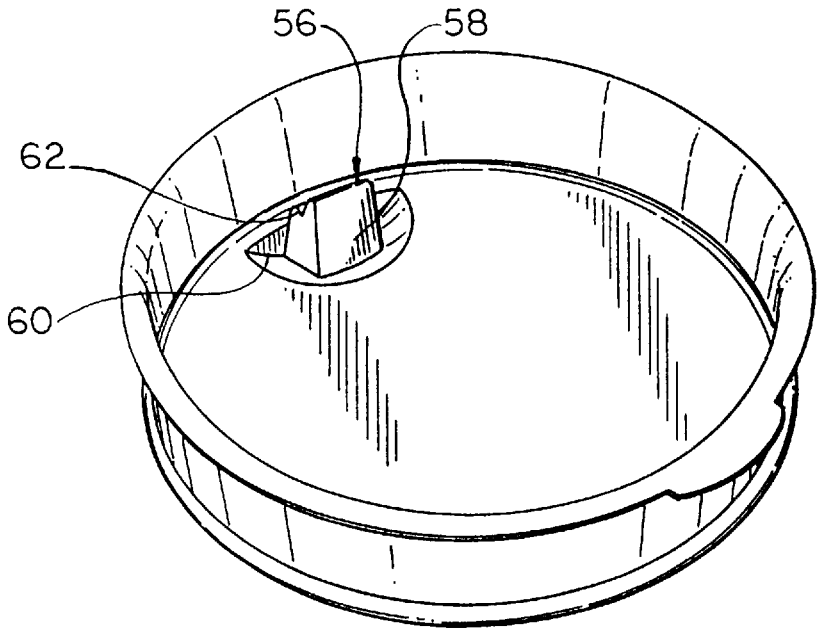
FIG. 25 is a perspective view of another embodiment of the lid in accordance with the invention having liquid port device in a first position.

FIG. 25 is a perspective view of a lid having a fluid port device 56 in a first or sealed position. The fluid port device 56 includes a protuberance 58 and a rupturable membrane or region 60 of the lid that has weakened tensile strength. The protuberance 58 can include a locking slot 62 to secure the fluid port device 56 in a second or open position. The protuberance 58 is also movable from the open position to the closed position to reseal the lid.

Figure 26:
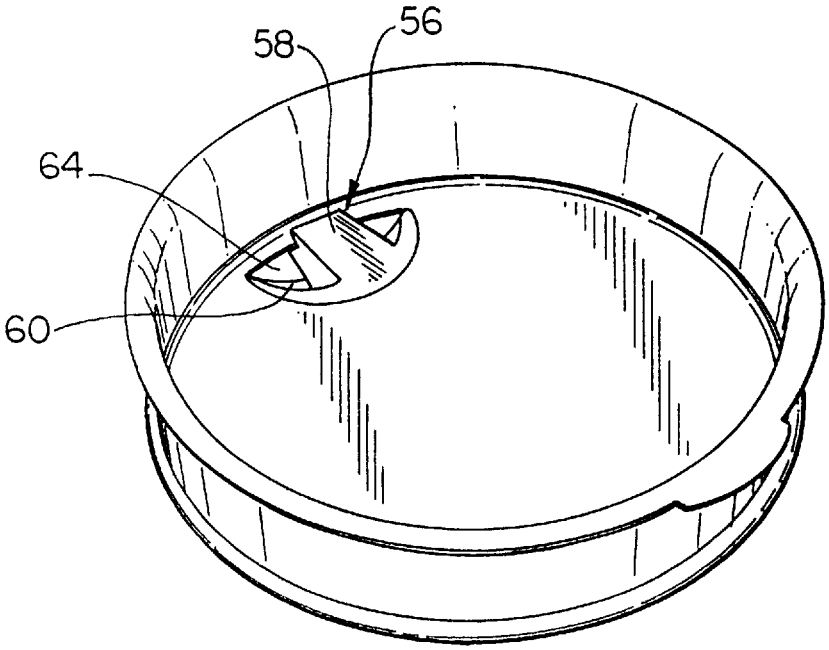
FIG. 26 is a perspective view of the lid of FIG. 25 showing the liquid port device in a second position.

FIG. 26 illustrates the protuberance 58 bent or pushed toward the base of the lid to transition the fluid port device 56 from the first position to the second position. As the protuberance 58 is moved, the weakened region 60 of the lid tears or separates to provide a fluid port 64 or a fluid passage through the lid. The locking slot 56 engages a portion of the lid to impede further downward movement or return of the protuberance 58 toward the first position.

Figure 30:
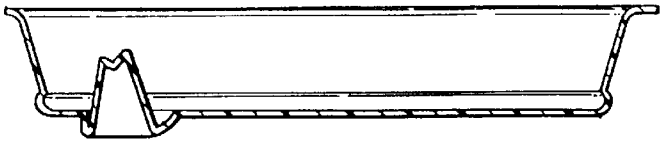
FIG. 30 is a sectional view of the lid of FIG. 25.
Figure 29:
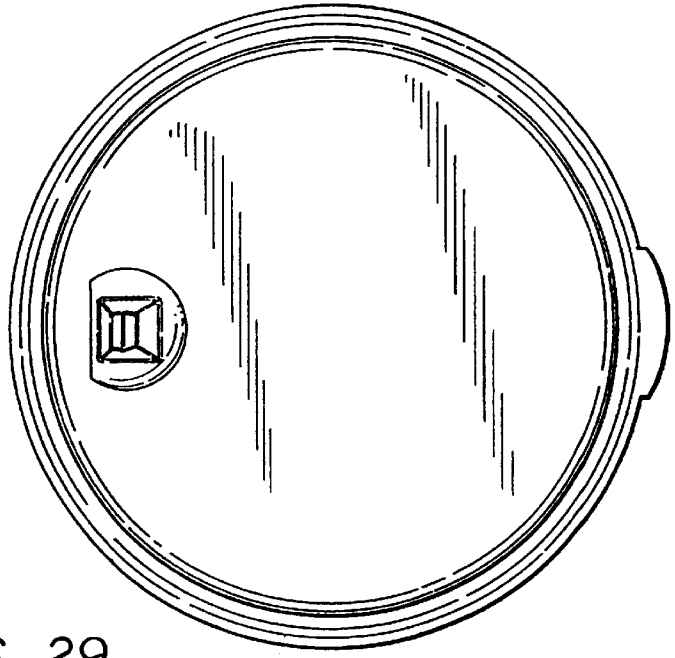
FIG. 29 is a bottom view of the lid of FIG. 25.
Figure 27:
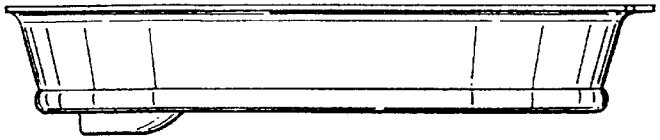
FIG. 27 is a side view of the lid of FIG. 25.
Figure 28:
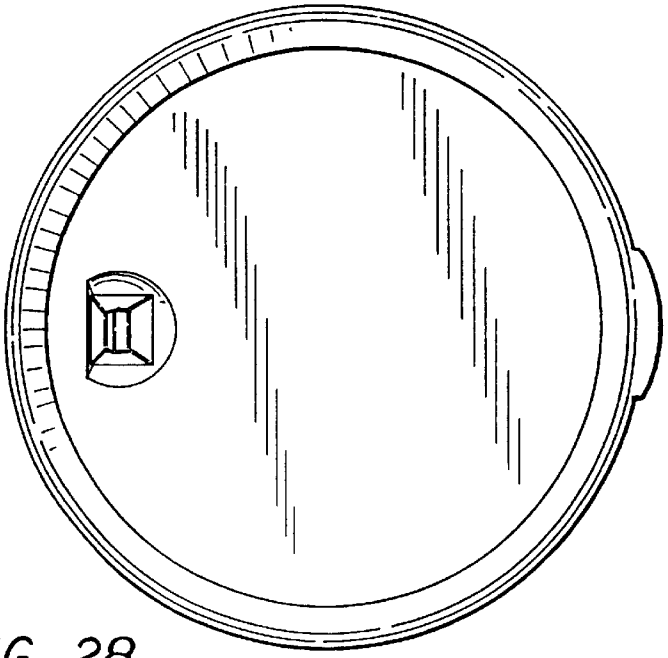
FIG. 28 is a top view of the lid of FIG. 25.
Figure 31:
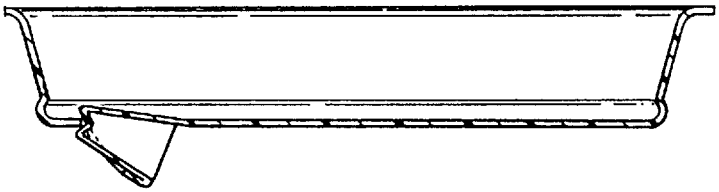
FIG. 31 is a sectional view of the lid of FIG. 26.

FIG. 27 is a side view of the lid illustrated in FIG. 25. FIGS. 28 and 29 are top and bottom views respectively of the lid shown in FIG. 25, wherein the fluid port device is in the first or closed position. FIG. 30 is a sectional view of the lid illustrated in FIG. 25, wherein the fluid port device is in the first or closed position. FIG. 31 is a sectional view of the lid illustrated in FIG. 26, wherein the fluid port device is in the second or open position.

Figure 32:
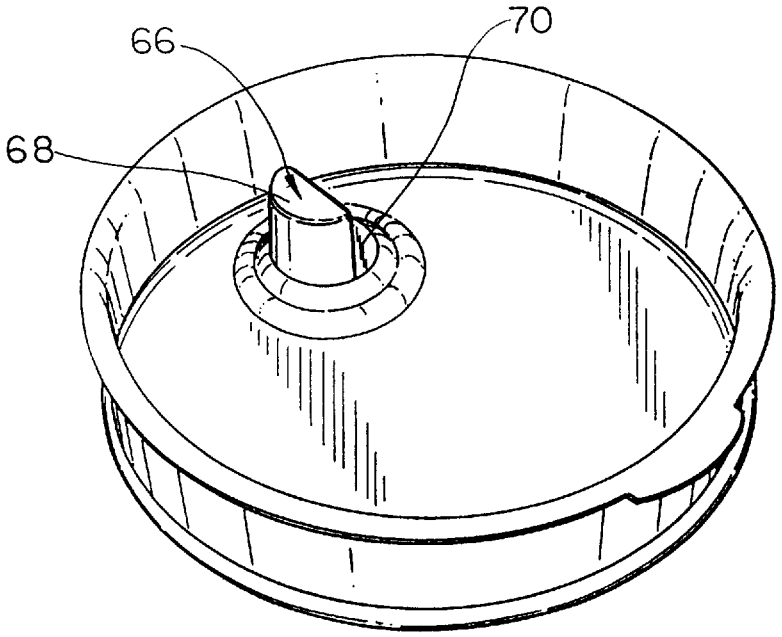
FIG. 32 illustrates still another embodiment of the lid, wherein the lid includes another embodiment of a liquid port device in a first position.

Another embodiment of the lid that includes an alternative embodiment of a fluid port device is illustrated in FIGS. 32–38. FIG. 32 is a perspective view of a lid having a fluid port device 66 in a first or sealed position. The fluid port device includes a protuberance 68 and a rupturable membrane or region 70 of the lid that has weakened tensile strength. The protuberance 68 can be locked into place to secure the fluid port device in a second or open position by material deformation around the protuberance.

Figure 33:
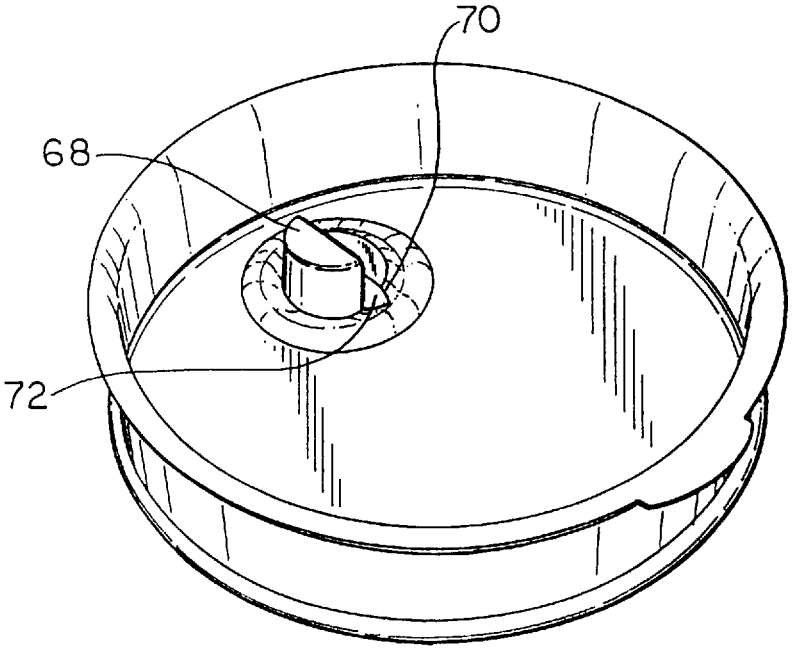
FIG. 33 is a perspective view of the lid of FIG. 32 showing the liquid port device in a second position.

FIG. 33 illustrates the protuberance 68 pushed down towards the base of the lid to transition the fluid port device 66 from the first position to the second position. As the protuberance 68 is moved, the weakened region 70 of the lid tears or separates to provide a fluid port 72 or a fluid passage through the lid. The material around the protuberance 68 deforms to a limited extent to impede further downward movement or return of the protuberance toward the first position.

Figure 37:
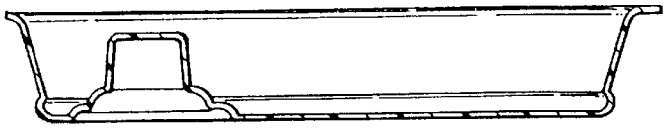
FIG. 37 is a sectional view of the lid of FIG. 32.
Figure 36:
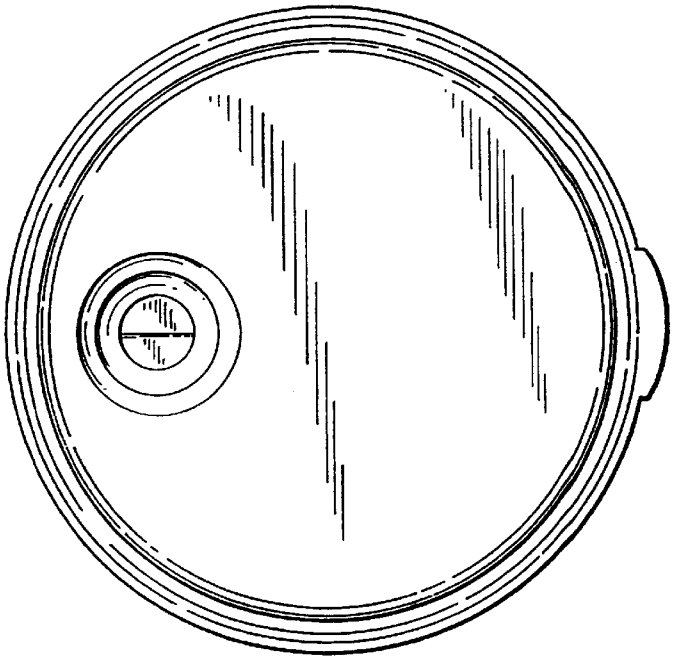
FIG. 36 is a bottom view of the lid of FIG. 32.
Figure 34:
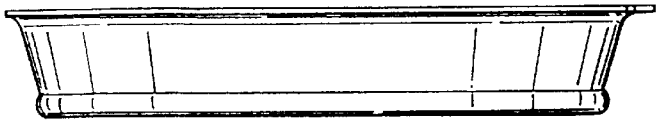
FIG. 34 is a side view with the lid of FIG. 32.
Figure 35:
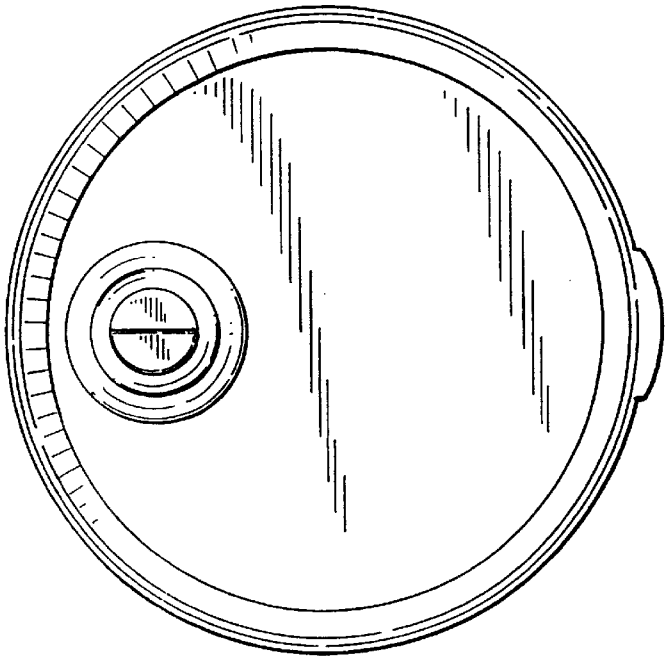
FIG. 35 is a top view of the lid of FIG. 32.
Figure 38:
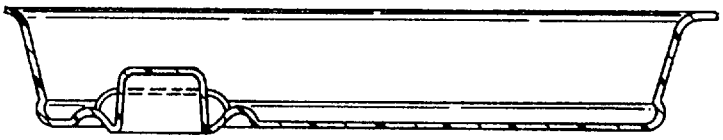
FIG. 38 is a sectional view of the lid of FIG. 33.

FIG. 34 is a side view of the lid of FIGS. 32 and 33. FIGS. 35 and 36 are top and bottom views, respectively, of the lid of FIG. 32. FIG. 37 is a sectional view of the lid in FIG. 32 illustrating the fluid port device in the first or closed position. FIG. 38 is a sectional view of the lid illustrated in FIG. 33, wherein the fluid port device is in the second or open position. In this embodiment of the lid, a bi-stable geometry allows the fluid port to be opened or closed by pressing or "popping" the protuberance.

Figure 39:
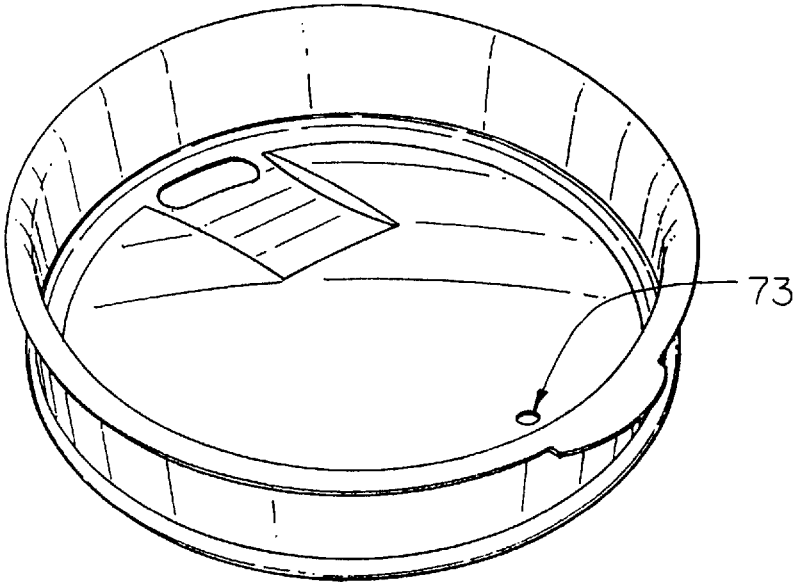
FIG. 39 is a perspective view of a lid according to the invention that includes a vent.
Figure 40:
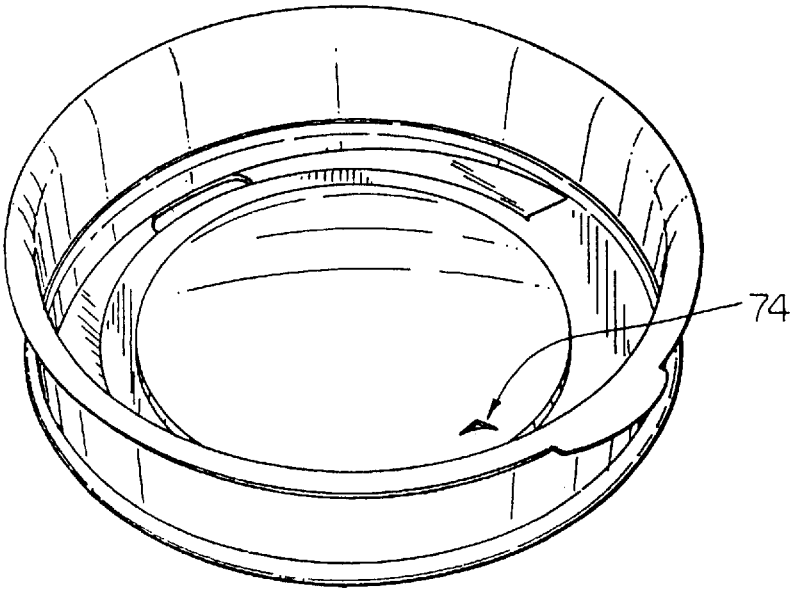
FIG. 40 is a perspective view of another lid according to the invention that includes a different vent.

Although not illustrated in the preceding figures, it should be appreciated that any of the lid configurations can include a vent or hole in the lid for steam venting and/or pressure equalization. FIG. 39, for example, is a perspective view of a lid according to the invention that includes a vent 73 that is a substantially circular punched hole. FIG. 40 is a perspective view of another lid according to the invention that includes a vent 74 that is a chevron shaped lanced hole. Other geometries for the vent are possible.

Figure 41:
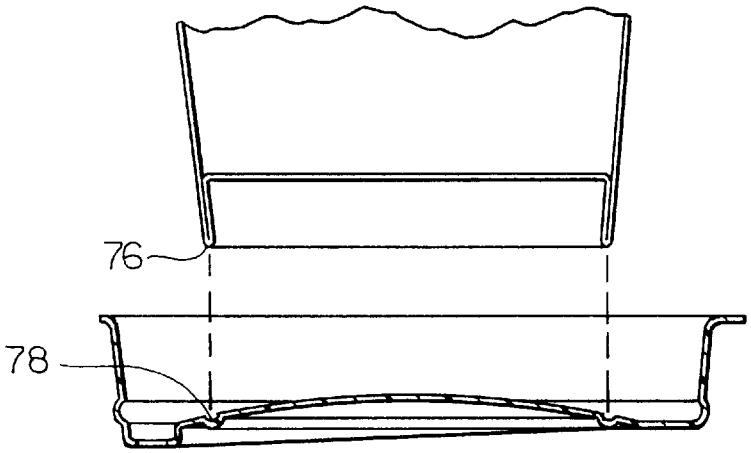
FIG. 41 is a sectional view of a cup and lid that includes stacking features in accordance with the invention.

FIG. 41 illustrates yet another feature of the invention, wherein the base of a cup 76 has a diameter and shape corresponding to that of a circular groove 78 in the base of a lid. This feature allows stacking of covered cups.

Figure 42:
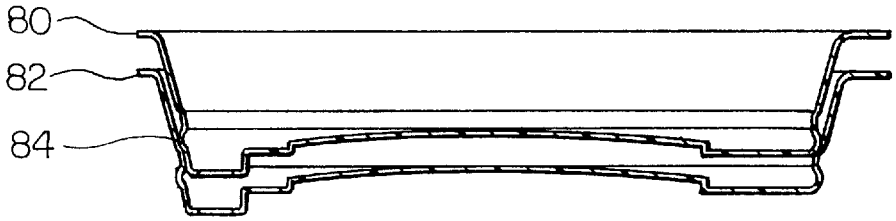
FIG. 42 is a sectional view of nested lids in accordance with the invention.

FIG. 42 illustrates yet another feature of the invention, wherein a first lid 80 is nested within a second lid 82. A locking ring 84 of the first lid engages the tapered inner wall of the second lid to prevent the lid bases from making contact.

Figure 43:
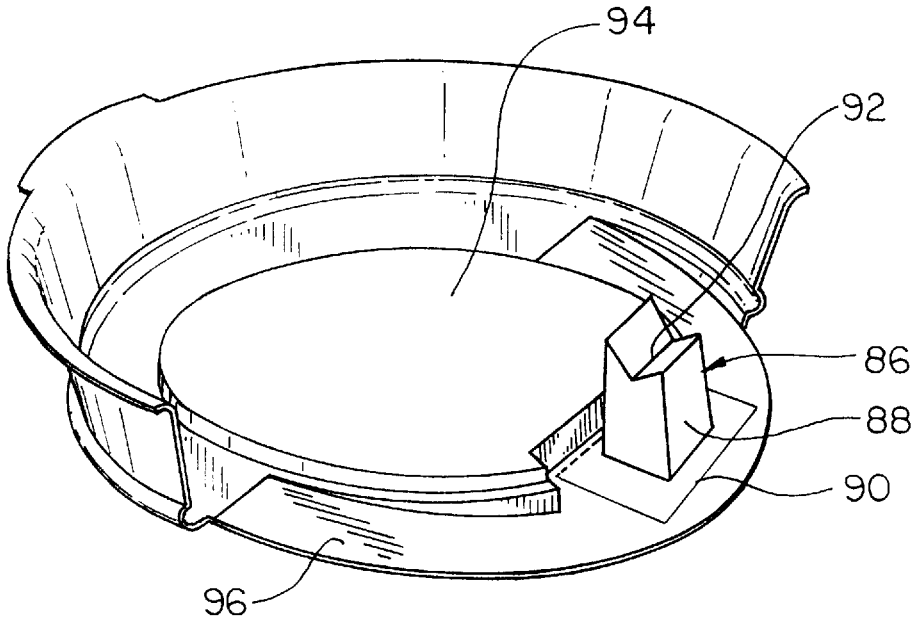
FIG. 43 is a partial cut-away view of yet another lid in accordance with the invention showing a liquid port device in a first position.

FIG. 43 is a perspective view of yet another embodiment of a lid in accordance with the invention. The lid includes a fluid port device 86 in a first or sealed position. The fluid port device 86 includes a protuberance 88 and a rupturable membrane or region 90 of the lid that has weakened tensile strength. The protuberance 88 can include a locking slot 92 to secure the fluid port device 86 in a second or open position. The protuberance 88 is also movable from the open position to the closed position to reseal the lid. This embodiment of the lid includes a raised center portion 94 that can be substantially flat as shown or convex. The diameter of the raised center portion 94 corresponds to the diameter of the recessed bottom portion of the cup to facilitate stacking a second cup on the lid of a covered first cup. The lid also includes a circumferential inclined portion 96 that urges coffee on the top of the lid toward the fluid port device 86.

Figure 44:
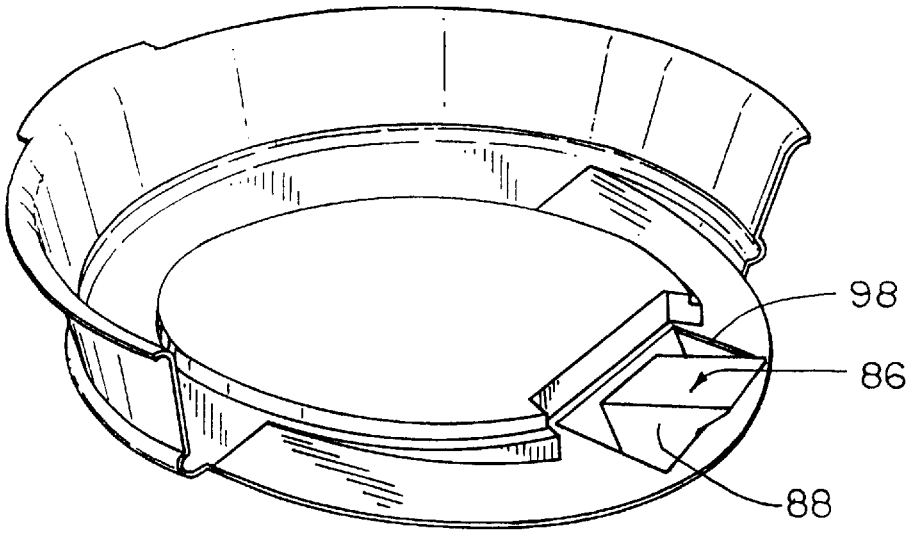
FIG. 44 is a partial cut-away view of the lid of FIG. 43 showing the liquid port device in a second position.

FIG. 44 illustrates the protuberance 88 bent or pushed toward the base of the lid to transition the fluid port device 86 from the first position to the second position. As the protuberance 88 is moved, the weakened region 90 of the lid tears or separates to provide a fluid port 98 or fluid passage through the lid. The locking slot engages a portion of the lid to impede further downward movement or return of the protuberance 88 toward the first position.

Although the invention has been shown and described with respect to exemplary embodiments thereof, various other changes, omissions, and additions in form and detail thereof may be made therein without departing from the spirit and scope of the invention.

What is claimed is:

1. A cup comprising:

a resilient, hollow, frustroconical body open at a first end and closed at a second end, wherein said first end has a greater diameter than said second end, and wherein said body includes a wall having an inner face and an outer face, said wall extending from said first end to said second end, said wall having an outwardly rolled lip at said open first end, a plurality of insulating bodies integral with said outer face of said wall, said insulating bodies having an insulating value, and a plurality of thermally conductive channels among said plurality of insulating bodies, said thermally conductive channels having an insulating value that is less than said insulating value of said insulating bodies, and wherein said insulating bodies are configured as identifying indicia.

2. The cup of claim 1, further comprising a groove subjacent to said outwardly rolled lip and inscribed in said inner face of said wall.

3. The cup of claim 1, wherein said insulating bodies configured as identifying indicia comprise alpha numeric indicia separated by thermally conductive channels.

4. The cup of claim 1, wherein said insulating bodies and said thermally conductive channels are elongate and interdigitated.

5. The cup of claim 1, wherein said insulating bodies have a uniform shape and are uniformly distributed on the outer face of the wall of said cup.

6. The cup of claim 1, wherein said insulating bodies and said thermal channels are disposed on the outer face of the wall of said cup in an irregular configuration.

7. The cup of claim 1, wherein said insulating bodies and said outer face of said wall of said cup define a double-wall structure.

8. The cup of claim 7, wherein said double-wall structure is hollow.

9. The cup of claim 7, wherein said double-wall structure is filled with an insulating material.

10. The cup of claim 7, wherein said double-wall structure is crush resistant.

11. The cup of claim 1, wherein said cup further comprises a plurality of stacking bumps which increase the diameter of said cup at a plurality of localized regions.

12. The cup of claim 11, wherein each of said stacking bumps are located on an insulating body.

13. The cup of claim 1, wherein said identifying indicia comprise pictorial indicia separated by thermally conductive channels.

14. A cup comprising:

a resilient, hollow, frustroconical body open at a first end and closed at a second end, wherein said first end has a greater diameter than said second end, and wherein said body includes a wall having an inner face and an outer face, said wall extending from said first end to said second end, and said wall having an outwardly rolled lip at said open first end;

a plurality of insulating bodies integral with said outer face of said wall, said insulating bodies having an insulating value;

a plurality of thermally conductive channels among said plurality of insulating bodies, said thermally conductive channels having an insulating value that is less than said insulating value of said insulating bodies;

a groove subjacent to said outwardly rolled lip and inscribed in said inner face of said wall; and a lid comprising:

a resilient, hollow, frustroconical body open at a first end and closed at a second end, wherein said first end has a greater diameter than said second end, and wherein said body includes a wall having an inner face and an outer face, said wall extending from said first end to said second end, and said wall having an outwardly flared lip at said open first end;

a locking ring subjacent to said outwardly flared lip, said locking ring adapted for insertion into said groove of said cup;

said closed second end of said lid defining a fluid port; and said lip of said lid having a diameter that is less than the diameter of said open first end of said cup.

15. The cup claim 14, wherein said closed second end of said lid includes a convex surface and said fluid port is lower than said convex surface.

16. The cup of claim 15, wherein said closed second end of said lid further includes a channel providing a path to said fluid port.

17. The cup of claim 16, wherein said channel is inclined.

18. The cup of claim 16, wherein said convex surface is at least partially surrounded by said channel and said channel is lower than said convex surface.

19. The cup of claim 14, wherein said insulating bodies are configured as identifying indicia separated by thermally conductive channels.

20. The cup of claim 14, wherein said insulating bodies configured as identifying indicia comprise alphanumeric indicia separated by thermally conductive channels.

21. The cup of claim 14, wherein said insulating bodies configured as identifying indicia comprise pictorial indicia separated by thermally conductive channels.

22. The cup of claim 14, wherein said insulating bodies and said thermally conductive channels are elongate and interdigitated.

23. The cup of claim 14, wherein said insulating bodies have a uniform shape and are uniformly distributed on the outer face of the wall of said cup.

24. The cup of claim 14, wherein said insulating bodies and said thermal channels are disposed on the outer face of the wall of said cup in an irregular configuration.

25. The cup of claim 14, wherein said insulating bodies and said outer face of said wall of said cup define a double-wall structure.

26. The cup of claim 25, wherein said double-wall structure is hollow.

27. The cup of claim 25, wherein said double-wall structure is filled with an insulating material.

28. The cup of claim 25, wherein said double-wall structure is crush resistant.

29. The cup of claim 14, wherein said cup further comprises a plurality of stacking bumps which increase the diameter of said cup at a plurality of localized regions.

30. The cup of claim 29, wherein each of said stacking bumps are located on an insulating body.

31. The cup of claim 14, wherein said closed second end of said lid includes a circular groove having a shape and a diameter and wherein said cup includes a base portion having a shape and a diameter corresponding to said shape and said diameter of said circular groove.

32. A cup comprising:

a resilient, hollow, frustroconical body open at a first end and closed at a second end, wherein said first end has a greater diameter than said second end, and wherein said body includes a wall having an inner face and an outer face, said wall extending from said first end to said second end, and said wall having an outwardly rolled lip at said open first end;

a plurality of insulating bodies configured as alpha numeric indicia separated by thermally conductive channels, said insulating bodies being integral with said outer face of said wall, said insulating bodies having an insulating value, and said insulating bodies and said outer face of said wall of said cup defining a double-wall structure;

a plurality of thermally conductive channels among said plurality of insulating bodies, said thermally conductive channels having an insulating value that is less than said insulating value of said insulating bodies;

a groove subjacent to said outwardly rolled lip and inscribed in said inner face of said wall;

a lid including a resilient, hollow, frustroconical body open at a first end and closed at a second end, wherein said first end has a greater diameter than said second end, and wherein said body includes a wall having an inner face and an outer face, said wall extending from said first end to said second end, and said wall having an outwardly flared lip at said open first end;

a locking ring subjacent to said outwardly flared lip, said locking ring adapted for insertion into said groove of said cup;

said closed second end of said lid defining a fluid port; and said lip of said lid having a diameter that is less than the diameter of said open first end of said cup; and said closed second end of said lid including a convex surface, and said fluid port being lower than said convex surface.

33. The cup of claim 32, wherein said cup further comprises a plurality of stacking bumps on selected ones of said plurality of insulating bodies, said stacking bumps increasing the diameter of said cup at a plurality of localized regions.

34. The cup of claim 32, wherein said closed second end of said lid further includes an inclined channel providing a path to said fluid port, said convex surface being at least partially surrounded by said channel, and said channel being lower than said convex surface.

* * * * *